United States Patent [19]

Thomas, Jr., deceased et al.

[11] 4,176,584

[45] Dec. 4, 1979

[54] SLIDE LOCKING MECHANISM FOR MAGAZINE-FED FIREARMS

[76] Inventors: Frank S. Thomas, Jr., deceased, late of West Covina, Calif., by Phyllis Thomas, executrix, 2122 Pearl St., Santa Monica, Calif. 90405

[21] Appl. No.: 917,417

[22] Filed: Jun. 21, 1978

[51] Int. Cl.[2] ..... F41D 11/06

[52] U.S. Cl. ..... 89/138; 89/148; 89/190

[58] Field of Search ..... 89/138, 190, 196

[56] References Cited

U.S. PATENT DOCUMENTS

| | | | |
|---|---|---|---|
| 1,176,254 | 3/1916 | Smith | 89/190 |
| 2,115,041 | 4/1938 | Obregon | 89/138 |

FOREIGN PATENT DOCUMENTS

| | | | |
|---|---|---|---|
| 18363 | of 1910 | United Kingdom | 89/190 |

*Primary Examiner*—Stephen C. Bentley

[57] ABSTRACT

In a magazine-fed firearm having its barrel fixed to the frame and having a slide reciprocably mounted to the frame, with resilient means positioned between the slide and the frame urging the slide toward the muzzle, a lever rotatably mounted to the frame releasably engages notches formed in the slide, delaying opening of the breech momentarily after each firing to allow the internal gas pressure to reach a safe level, and retaining the slide with the breech open to signal the firing of the last cartridge. A resiliently biased plunger on the frame restrains the lever against rotation into and out of engagement with the notches.

20 Claims, 10 Drawing Figures

FIG. 4
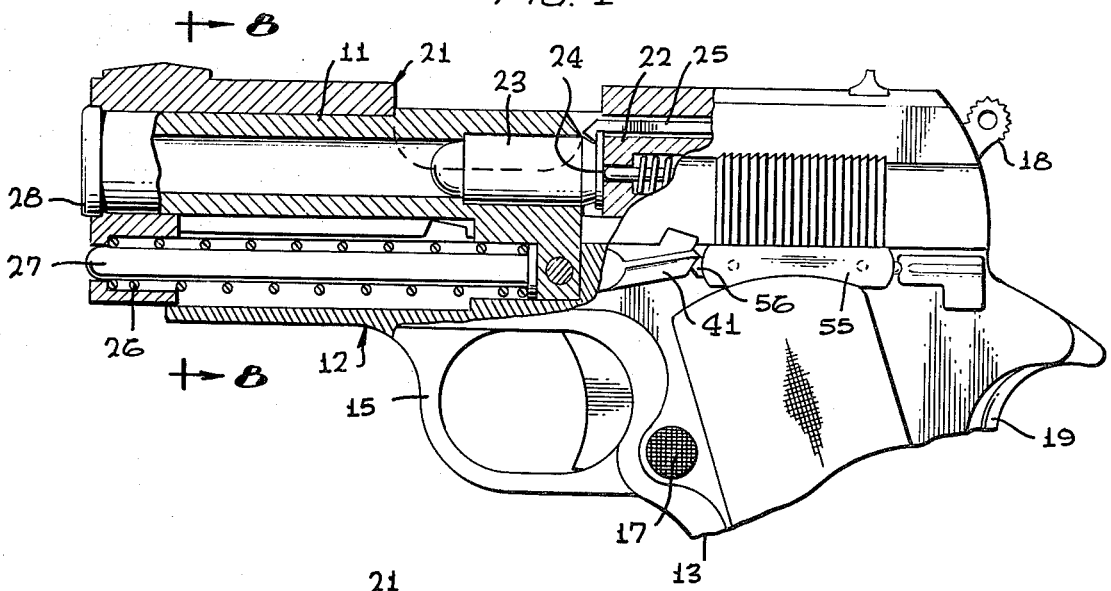
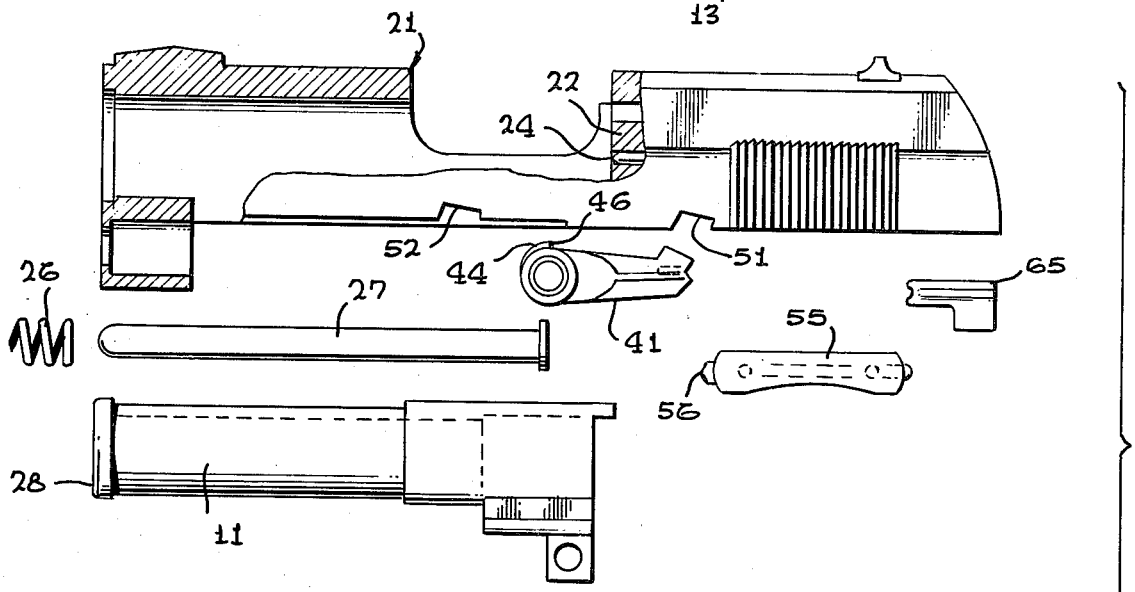
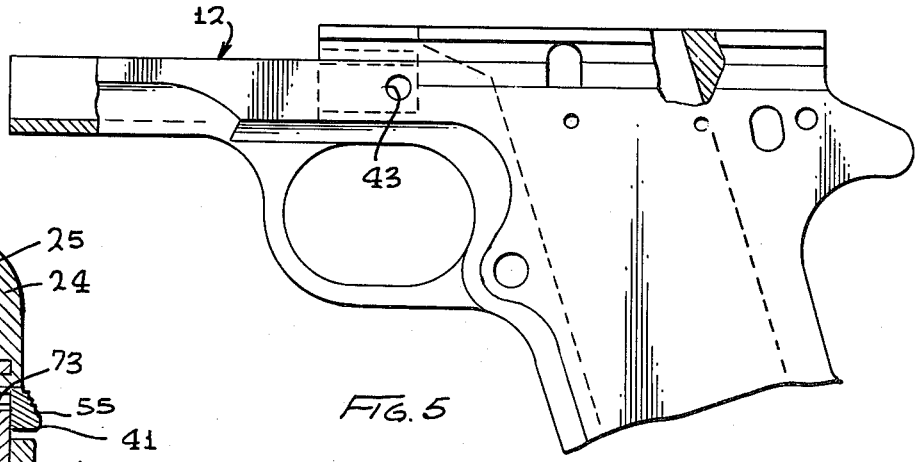
FIG. 5
FIG. 6
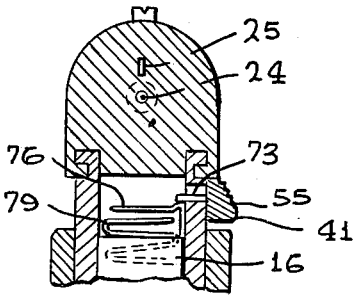

FIG. 7
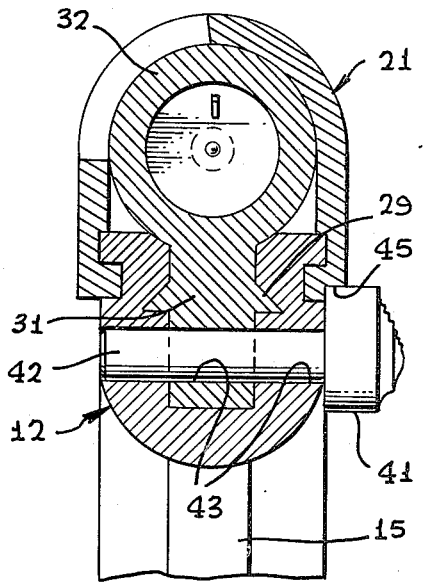
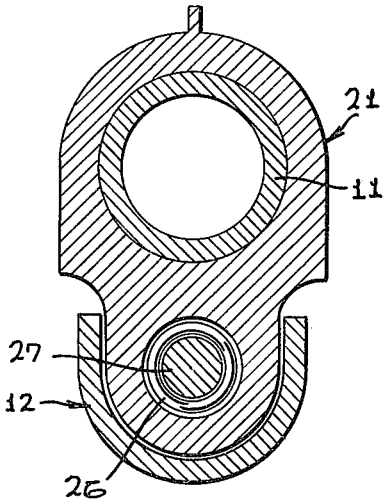
FIG. 8
FIG. 9
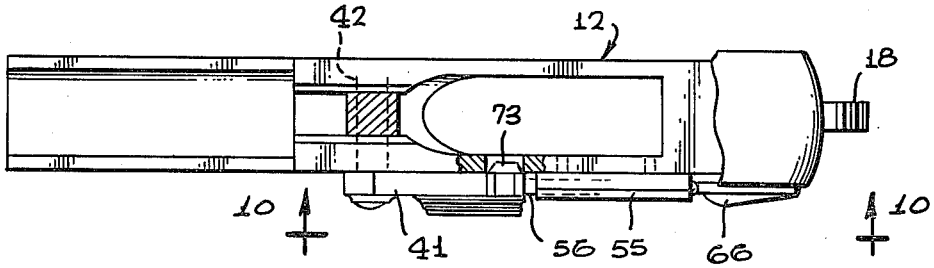
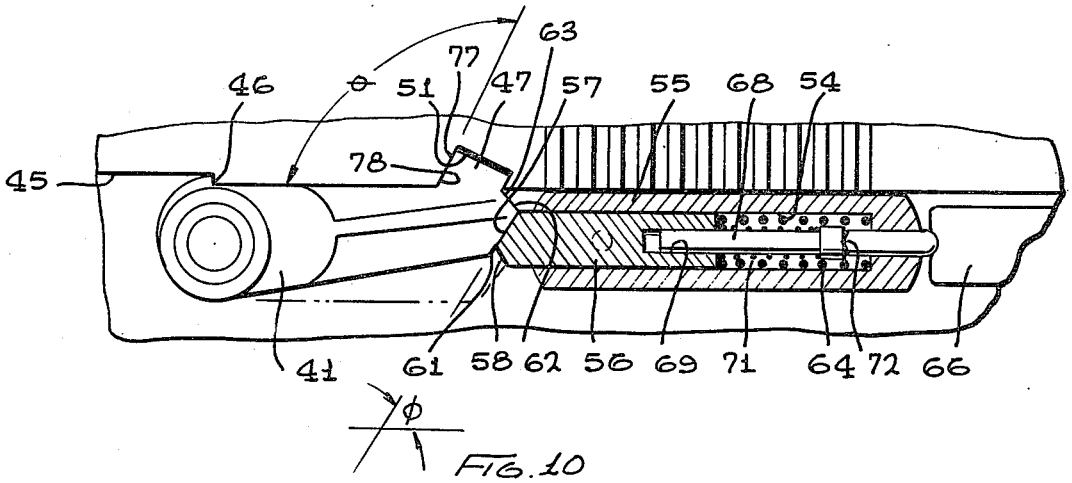
FIG. 10

SLIDE LOCKING MECHANISM FOR MAGAZINE-FED FIREARMS

BACKGROUND OF THE INVENTION

1. Field of the Invention

This invention relates to magazine-fed, recoil-operated automatic and semi-automatic firearms, and more particularly to firearms of this type, having the barrel fixed rigidly to the frame. Still more particularly it relates to an improved slide locking mechanism for such firearms.

2. Prior Art

In automatic and semi-automatic pistols a number of cartridges are carried within a removeable magazine or clip which is inserted into the handle or grip of the weapon. When the weapon is fired, a sliding member mounted on the frame over the barrel and firing chamber is driven rearwardly by recoil to withdraw the spent cartridge from the firing chamber and eject it from the weapon. The sliding member is then returned to the battery position by a recoil spring and is adapted to strip the succeeding round from the magazine and insert it into the firing chamber in readiness for firing.

Almost instantly following the impact of the firing pin with the primer in the cartridge, the propellent powder within the cartridge case is ignited and the resultant high pressure gases drive the bullet or projectile through the barrel toward the muzzle. The gases generated by a modern 0.45 calibre cartridge reach pressures of the order of 18,000 p.s.i. to 22,000 p.s.i. before the bullet or projectile clears the muzzle. It is the recoil opposing the thrust of these gases against the bullet which opens the slide member in weapons of this type. Over the years a great many ingenious systems have been devised to prevent the premature opening of the slide with its attendant potentially disasterous results.

The most commonly used mechanisms for holding the action closed during the period in which the gases are at a pressure considered unsafe are those in which some locking means are contrived to hold the barrel together with the breech face of the slide so that the barrel and slide or breech face move rearwardly under the influence of recoil locked together as a single unit. When the gas pressure has reached a safe level, one of several mechanisms is utilized to unlock the slide from the barrel, thus allowing the slide to go into full recoil while the barrel returns to battery or some other position.

Unquestionably many of these prior art devices have served their intended functions well. In most cases they have been costly to incorporate within the general design of small arms, however, and many of them have been found to require considerable maintenance. The accuracy of these weapons is known to be adversely affected to some extent by the compound action of the locking mechanism, and to an even greater degree by the attendant disturbance of the axial alignment of the barrel.

To exacerbate these deficiencies, in a number of weapons of this type, the relatively loose tolerances required between the moving parts are such that the compound action reduces accuracy still further.

By way of example, in the case of the well known Colt 0.45 calibre Government Model 1911 semi-automatic pistol to which my invention is readily adaptable, male buttresses and female grooves or annuli lock the slide and barrel together.

While this locking system performs satisfactorily in securing the barrel and slide, unlocking means must be provided to release the two members at a strategically predetermined time following gas pressure peaking. In the Colt pistol this is achieved by connecting the rear end of the barrel to the frame by means of a link, the upper end of which is rotatably attached to a lug on the underside of the breech, and the lower end of which is rotatably attached to the frame. When the weapon is fired, the engaged buttresses and annuli cause the slide and barrel to move rearwardly in recoil as a single unit. As the link rotates about its axis of pivotal attachment to the frame, it draws the breech end of the barrel toward the frame and the buttresses and annuli out of engagement, thereby freeing the slide to move rearwardly to the full recoil position and the barrel to return to its original position at battery. In this particular weapon, disengagement of the barrel and slide is accompanied by a rotational movement of the barrel of the magnitude of 10°–15° from its original sighted alignment.

One object of the subject invention is to provide a small compact firearm which has a fixed barrel and therefore does not rely on such accessory devices as the Colt interlocking buttresses and annuli and rotatable link to prevent the premature opening of the slide. Another object is to provide a locking system for a magazine-fed firearm having a fixed barrel, having a sturdy, durable, effective slide retarding and locking mechanism, which is inexpensive to produce, requires little if any maintenance, and does not impair the accuracy of the weapon.

As will be seen, the subject invention more than satisfies these objects.

SUMMARY OF THE INVENTION

In an automatic or semi-automatic magazine-fed firearm embodying the subject invention, the barrel is immoveably fixed to the frame. As in the Colt 0.45, the slide is reciprocably mounted to the frame and urged in the direction of the muzzle by a spring positioned between the slide and the frame.

A lever positioned at the side of the frame, just below the lower edge of the skirt of the slide, is rotatably supported at one of its ends on a shaft passing transversely through the frame. A pair of recesses formed in the skirt of the slide are shaped to conform to the profile of an upwardly extending angular lobe formed on the free end of the lever. The first of these recesses is positioned to register with the lobe when the slide is in the battery position, and the second to register with it when the slide is at or near its full recoil position.

The mating faces of the lobe and the first recess are inclined, to produce a caming action tending to urge the lobe out of engagement with the recess under the influence of the recoil force generated when the weapon is fired. Friction between these faces resists their sliding motion. A resiliently biased plunger mounted to the frame adjacent the first recess abuts the lever and is adapted to provide further resistance against disengagement of the lobe. The combined effect of the frictional caming action and the restraining force exerted by the plunger is to delay the release of the slide and its rearward motion under the influence of recoil force, until after the pressure of the gases in the chamber has diminished to a safe level.

The plunger is further adapted to engage the lever after the lobe has been forced out of engagement with the first recess, and to hold it out of contact with the lower edge of the slide.

A groove formed in the side of the skirt of the slide at its lower edge terminates in a buttress positioned to engage an upwardly extending ear formed on the lever, when the slide returns to the battery position, thereby rotating the lever out of alignment with the plunger and forcing the lobe into the first recess.

An inwardly extending limb formed on the lever projects through an opening in the frame into the path of the magazine follower. When the last cartridge is fired, the follower spring forces the lever out of alignment with the plunger (which has been retaining the lever out of contact with the slide), and drives the lobe into engagement with the second recess, thereby locking the slide with the breech open. Once again, the combined effect of the friction between the mating faces of the recess and the lobe, and force exerted against the end of the lever by the plunger prevent the lobe from being disengaged unintentionally.

While the forces retaining the lobe in the two recesses are substantial, they can be readily overcome by manual force exerted downwardly on the lever, if it is desired to release the slide. Thus, when the spent magazine has been replaced, downward force applied by the thumb to the lever will free the slide to strip a cartridge from the magazine, seat it in the breech, and return to the battery position with the weapon in readiness for firing.

For added protection against accidental discharge, a manually operated safety is included, which disables the linkage between the trigger and the hammer-release mechanism, and at the same time prevents the plunger from moving sufficiently to allow the slide lock lever to rotate out of engagement with the first recess.

The construction and operation of the subject invention will be more fully understood, and others of its objects appreciated, from a reading of the following detailed description of one of its preferred embodiments as illustrated by the accompanying drawings.

THE DRAWING

FIG. 4 is a partial side elevational view of the pistol of FIG. 1, with portions cut away to expose its internal features;

FIG. 5 is an exploded side elevational view of the pistol of FIG. 1, with portions cut away to expose its internal features;

FIG. 6 is a sectional view taken through the pistol of FIG. 3 in the direction 6—6;

FIG. 7 is an enlarged partial sectional view taken through the pistol of FIG. 1 in the direction 7—7;

FIG. 8 is an enlarged sectional view taken through the pistol of FIG. 1 in the direction 8—8;

FIG. 9 is a reduced top plan view of the pistol of FIG. 4, with portions cut away to expose its internal features; and FIG. 10 is an enlarged fragmentary side elevational view of the slide locking mechanism of the pistol of FIG. 9, taken in the direction 10—10, with portions cut away to expose its internal features.

Wherever practicable, the same numeral is used to depict the same or functionally equivalent components in the several figures.

DETAILED DESCRIPTION

Figure 1:
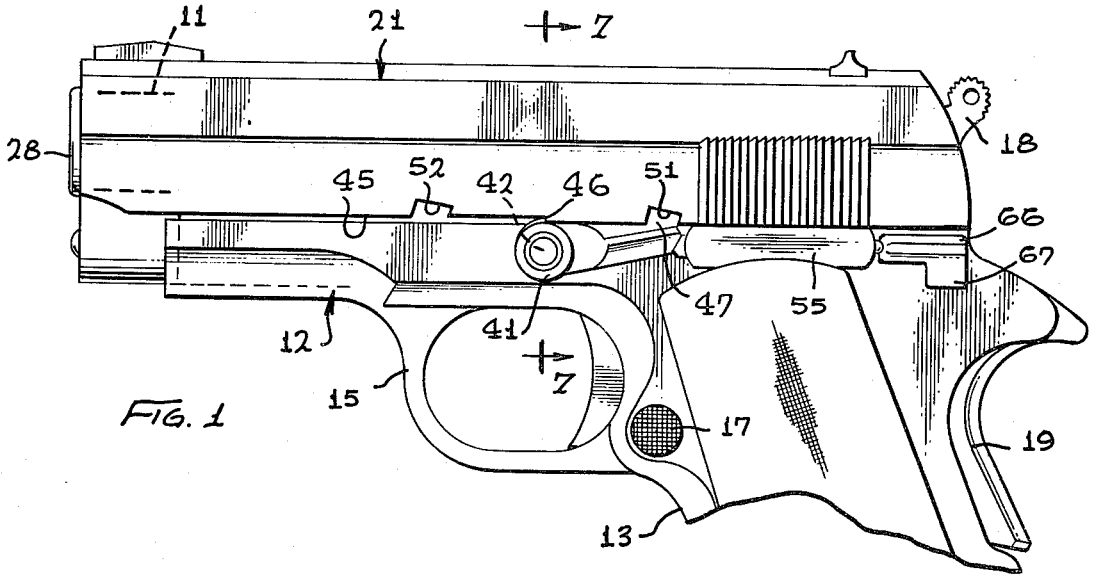
FIG. 1 is a partial side elevational view of a typical 0.45 calibre semi-automatic magazine-fed pistol embodying the subject invention, with the slide in the battery position.

Referring to FIGS. 1-5, the weapon illustrated has its barrel 11 fixed to frame 12 which includes a handle 13 having conventional grips 14, and trigger housing and guard 15. The handle 13 is adapted to receive a standard magazine 16 containing 0.45 calibre cartridges. Magazine release button 17 releases the magazine for withdrawal from the receiver.

The weapon uses conventional firing means, including a hammer 18 mounted on the rear end of the frame 12, and more or less standard trigger bar, sear, and release mechanisms (not shown), and is provided with a grip safety 19. The construction and operation of all of these are well known and require no further elaboration.

Slide 21 contains a conventional breech block 22 having a face adapted to abut the base of a cartridge case 23 seated in the firing chamber of the barrel 11. The standard firing pin 24 and cartridge case extractor 25 extend through the face of the breech block 22.

Figure 2:
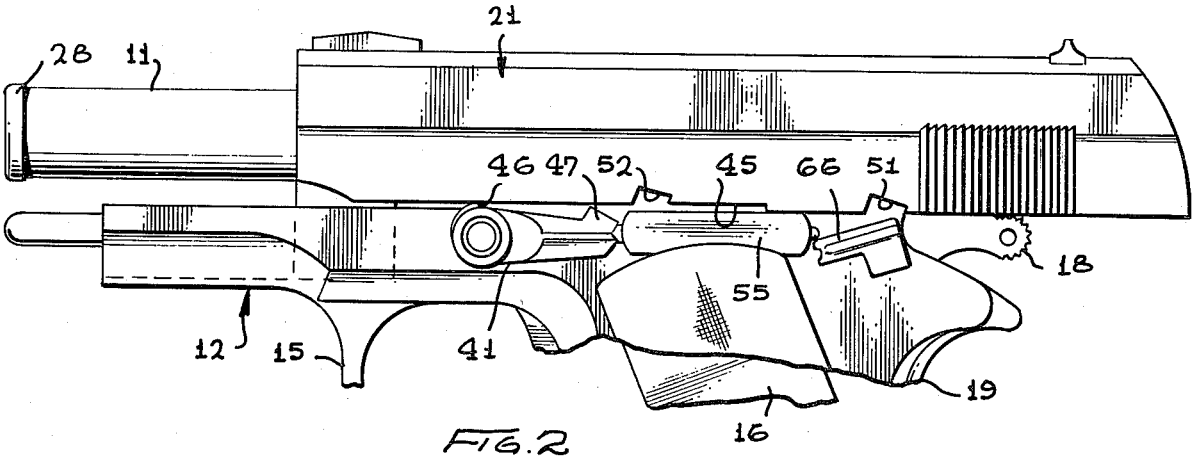
FIG. 2 is a partial side elevational view of the pistol of FIG. 1, with the slide in full recoil.

As in conventional magazine-fed firearms of this type, slide 21 travels between the forwardmost or battery position shown in FIG. 1, in which the breech block 22 is in tight abutment with the seated cartridge case 23 and only the muzzle 28 of barrel 11 is exposed, and the rearwardmost or full-recoil position shown in FIG. 2. A recoil spring 26 carried on recoil spring guide 27 extending rigidly from frame 12 below the barrel 11, acts between frame 12 and slide 21 to urge the latter into the battery position.

As more clearly seen in FIGS. 7 and 8, barrel 11 is preferably attached to frame 12 by means of interlocking dovetails 29 on a lug 31 formed on the underside of barrel 11 near the breech 32.

A slide lock lever 41 is rotatably mounted to the side of frame 12 just below the lower edge of the skirt of slide 21 by means of shaft 42 which is journalled through shaft-receiving openings 43 formed in frame 12 and lug 31. Shaft 42 serves not only as an axle for lever 41, but also as a releasable lock securing barrel 11 immoveably to frame 12.

An ear 44 formed on the enlarged forward end of lever 41 extends upwardly into a groove 45 in the lower edge of the skirt of slide 21. Groove 45 terminates at its rear end a buttress 46 positioned to engage ear 44 with slide 21 displaced slightly rearwardly of its battery position. Forcefully driven against ear 44 under the influence of recoil spring 26, buttress 46 causes lever 41 to rotate upwardly in the direction of slide 21.

An angular lobe 47 is formed on the free end of lever 41. Lobe 47 is contoured to conform closely to a pair of substantially identical recesses 51 and 52 formed in the skirt of slide 21. Recess 51 is positioned to register with lobe 47 when slide 21 is at battery.

A bore 54 is elongated housing 55 mounted to the side of frame 12 below the skirt of slide 21 contains reciprocable plunger 56 which is slidably supported for motion along an imaginary axis parallel with the imaginary axis of motion of slide 21. The forward end of plunger 56 protrudes from the end of housing 55.

The construction and interaction of lever 41 and plunger 56 are best seen in FIG. 10. The tip of plunger 56 is formed with an upper caming surface 57 and a lower bevel 58. Preferably, the upper caming surface 57 and the bevel 58 are inclined to the imaginary axis of motion of plunger 56 at an angle $\phi$ of about 60°. The free end of lever 41 is formed with a bevel 61 and a notch 62 conforming to the profile of the tip of plunger 56.

Housing 55 is positioned so that the upper caming surface 57 of plunger 56 is in alignment with the bevel 61 on lever 41 when the lobe 47 is seated in recess 51 or 52. Notch 62 is positioned in the end of lever 41 so that when lever 41 is rotated downwardly sufficiently for lobe 47 to clear the skirt of slide 21, the tip of plunger 56 is in alignment with notch 62. Stop means (not shown) are provided to prevent lever 41 from rotating downwardly beyond the point of alignment of plunger 56 and notch 62.

Compression spring 64 in the bore 54 of housing 55 urges plunger 56 into firm contact with the free end of lever 41.

With the tip of plunger 56 seated in notch 62, as shown in FIG. 2, and in phantom in FIG. 10, the force exerted by spring 64 serves to maintain lobe 47 out of contact with slide 21. When substantial force is exerted on lever 41, urging its free end to rotate upwardly toward slide 21, the caming action of lower caming surface 63 of notch 62 against bevel 58 overcomes the resistence of spring 64 and displaces plunger 56 from notch 62. Caming surface 57 acting on bevel 61 then urges lever 41 toward slide 21 and into engagement with recess 51 or 52.

Figure 3:
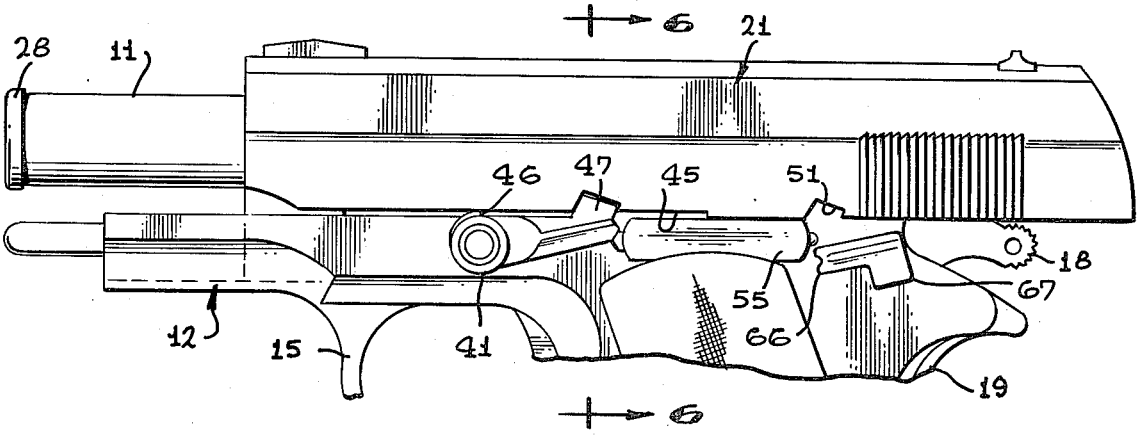
FIG. 3 is a partial side elevational view of the pistol of FIG. 1, with the slide locked in its open position to expose the breech.

When lobe 47 is seated in recess 51 or 52, as shown in FIGS. 1 and 3, the force exerted by spring 64 urges caming surface 57 on plunger into frictional contact with bevel 61 on the lower end of lever 41, thereby resisting any force tending to cause lever 41 to rotate downwardly and permit lobe 47 from becoming disengaged from its associated recess.

A manual safety 66 operated by a lever 67 rotatably mounted to the side of frame 12 at its rear end is adapted, using conventional means, to disable the firing action of the trigger.

Referring to FIG. 10, a safety rod 68 having a rounded tip extending rearwardly through the end of housing 55, is reciprocably supported by its other end in an axial bore 69 formed in plunger 56. A safety spring 71 positioned between plunger 56 and an annular buttress 72 formed on rod 68 urges the tip of rod 68 into engagement with a shallow recess or detent formed on the free end of safety lever 67, thereby retaining the manual safety 66 in the "safe" condition.

With safety lever 67 in this position, there is sufficient travel available to rod 68 in bore 69 to permit lever 67 to be rotated manually out of engagement with the rear end of rod 68. The length of rod 68 is such, however, that with lever 67 in the "safe" position, there is insufficient travel available to plunger 56 for it to be disengaged from either notch 62 or bevel 61. Thus, in addition to disabling the weapon's firing action, safety 66 effectively immobilizes slide lock lever 41 as well.

As best shown in FIGS. 6 and 9, a limb 73 is formed on the side of lever 41 near its free end, and extends inwardly of frame 12 through an opening in the frame adjacent the magazine receiver 74. Limb 73 is positioned to lie in the path of a boss 75 on the side of magazine follower 76.

When the last cartridge is striped from magazine 16 by the advancing slide 21, boss 75 is thrust upwardly against limb 73 by follower spring 79, urging the free end of lever 41 upwardly toward slide 21. The force exerted by spring 79 is readily overcome by the recoil force generated by the firing of the last cartridge; however, it is sufficient to disengage plunger 56 from notch 62 and to drive lobe 47 into recess 52 when, after recoiling fully, slide 21 starts to return to battery.

Recess 52 is located to register with lobe 47 when slide 21 is in its conventional "open" position, with the magazine receiver 74 and breech 32 fully exposed to warn the user that the last round has been fired and to permit inspection of the weapon.

To release slide 21, lever 41 is depressed manually. If a loaded magazine has been substituted for the exhausted one, the first cartridge is striped and seated in the firing chamber as the slide 21 returns to battery, and the weapon is again ready for firing.

While the cartridge case 23 remains tightly seated in the firing chamber, the high pressure gases generated by the cartridge's explosive discharge are trapped between the casing and the rapidly accelerating bullet. If the slide 21 were free to move rearwardly in instantaneous recoil, these gases would blow the casing out of the chamber with potentially lethal effect. Even the escaping gases themselves would pose a catastrophic threat to anyone near, muchless holding, the weapon.

Mating faces 77 and 78 of lobe 47 and recess 51, respectively, are adapted to serve as slide restraining means for delaying the operation of slide 21 in response to the recoil force produced by the firing of a cartridge.

The angle $\theta$ between the face 78 of recess 51, which serves as a cam when it abuts the face 77 of lobe 47, and the imaginary axis of motion of slide 21 (represented for practical purposes by the lower edge of the skirt of the slide), is carefully selected. Due regard must be given to the geometry of the slide lock lever 41 in plunger 56, the strength of plunger spring 64, the calibre of the weapon and strength of the charge anticipated to be used, and other pertinent factors, in order to insure a delay of several milliseconds after ignition of the propellant charge before the recoil force acting through slide 21 and lever 41 overcomes the resistance of plunger spring 64 to disengage lobe 47 from recess 51.

It appears that for most applications the angle $\theta$ will be between about 110° and about 120°, and preferably should be about 115°.

It will be appreciated from the foregoing description of one preferred embodiment that many other and varied constructions may be substituted for those shown and described here for illustrative purposes, without departing from the spirit and scope of the subject invention.

I claim:

1. In an automatic or semi-automatic magazine-fed firearm having a barrel fixed to a frame; a slide surrounding said barrel and with the breech thereof defining a cartridge receiver, said slide being reciprocably mounted to said frame for axial movement thereon between a firing chamber-sealing battery position at the muzzle-end of the frame and a full-recoil position at the other end of the frame; resilient means acting between said frame and said slide, urging said slide towards said battery position; and a cartridge magazine releasably insertable into said frame, said magazine including a cartridge-supporting follower and resilient means urging said follower into the path of movement of said slide; slide locking means comprising:

a lever rotatably mounted to said frame and having first caming means formed thereon;

first detent means on said slide, cooperatively engaging said first caming means with said slide in said battery position and thereby restraining said slide against movement out of said battery position;

second caming means on said lever, positioned in the path of movement of said slide; and cam engaging means on said slide, cooperatively engaging said second caming means in response to movement of said slide into said battery position, for rotating said lever and thereby forcing said first caming means into cooperative engagement with said first detent means, whereby movement of said slide out of said battery position upon discharge of a cartridge is delayed until the gases in said barrel produced by such discharge exit the muzzle, thereby reducing the gas pressure within the barrel to a predetermined safe level.

2. The slide locking means of claim 1, comprising further:

second detent means on said slide for cooperatively engaging said first caming means and thereby releasably locking said slide in a third position intermediate said battery position and said full-recoil position, wherein said cartridge receiver is in registry with said magazine; and third caming means on said lever, cooperatively engaging said magazine follower in response to the discharge of the last cartridge in said magazine, for rotating said lever and thereby forcing said first caming means into cooperative engagement with said second detent means.

3. The slide locking means of claim 2, comprising further:

a plunger reciprocably mounted to said frame adjacent said lever;

fourth caming means on said plunger, adapted to engage said lever and thereby resist disengagement of said first caming means and said first detent means when said first caming means and said first detent means are in engagement;

lever-engaging means on said plunger, adapted to engage said lever and thereby restrain said lever against rotation when said first caming means is out of engagement with said first detent means; and resilient means acting between said frame and said plunger, urging said fourth caming means and said lever-engaging means into alternate cooperative engagement with said lever.

4. The slide locking means of claim 3, comprising further:

manually operable safety means mounted to said frame effectively immobilizing said plunger with said forth caming means in engagement with said lever and thereby preventing disengagement of said first caming means and said first detent means.

5. The slide locking means of claim 4, wherein said safety means comprises a lever mounted to the frame for rotation into abutment with the end of said plunger remote from said fourth caming means.

6. The slide locking means of claim 3, wherein:

said first and second detents comprise first and second recesses, respectively, formed in the lower edge of the slide; and said first caming means comprises an angular lobe extending from said lever in the direction of said slide and having a profile conforming with the internal features of said recesses.

7. The slide locking means of claim 6, comprising further:

a lug formed on the underside of said barrel, having a shaft-receiving opening therein;

a shaft-receiving opening formed in the frame in registry with the opening in said lug;

cooperating slidingly engageable attachment means on the barrel and frame, releasably securing the barrel to the frame; and a shaft on the muzzle-end of said lever, journalled through said pin-receiving openings in said lug and frame and securing the barrel to the frame, thereby preventing said attachment means from becoming disengaged.

8. The slide locking means of claim 7, wherein:

the cam engaging means on the slide comprises a groove formed in the lower edge of the slide, terminating in a buttress; and said second caming means comprises an ear formed on said lever extending radially outwardly of said shaft and riding in said groove in the path of said buttress.

9. The slide locking means of said claim 8, wherein said third caming means comprise a limb formed on the end of said lever remote from the muzzle, extending inwardly of the frame in the path of the magazine follower.

10. The slide locking means of claim 6, wherein:

at least one wall of said first recess is inclined with respect to the axis of movement of said slide;

the profile of said lobe includes at least one face corresponding to said wall, which is inclined with respect to the axis of movement of said slide when said lobe is in engagement with said first recess; and said one face is adapted to engage said wall in sliding frictional abutment in response to the recoil force resulting from discharge of said firearm.

11. The slide locking means of claim 10, wherein said one face is inclined to the axis of movement of said slide, when said lobe is fully seated in said first recess, at an angle of between 110° and 120°.

12. The slide locking means of claim 11, wherein said angle is 115°.

13. The slide locking means of claim 10, wherein:

said fourth caming means comprises a first caming surface formed on the end of said punger adjacent said lever;

the end of said lever adjacent said plunger is beveled for cooperative frictional sliding abutment with said caming surface, whereby said end of the lever is urged in the direction of the slide by said plunger resilient means; pl said lever-engaging means comprises a bevel formed on the same end of said plunger as said first caming surface, and with said first caming surface defining a converging tip thereon; and the end of said lever adjacent said plunger is provided with a notch conforming to the converging tip of said plunger and including a second caming surface disposed for cooperative sliding abutment with the bevel on said plunger, whereby the tip of said plunger is forced out of engagement with said notch in response to rotation of said lever in the direction of said slide.

14. The slide locking means of claim 13, wherein said first caming surface is inclined to the axis of movement of said plunger at an angle of about 60°.

15. The slide locking means of claim 14, in combination with a magazine-fed semi-automatic firearm.

16. An automatic or semi-automatic magazine-fed firearm comprising:

a frame;

a barrel fixed to said frame;

a slide surrounding said barrel and containing a cartridge receiver, reciprocably mounted to said frame for sliding movement thereon axial of said barrel between a firing chamber-sealing battery position at the muzzle end of the frame and a full-recoil position at the other end of the frame;

resilient means positioned between said frame and said slide, urging said slide into said battery position;

a cartridge magazine releasably insertable into said frame and including a cartridge-supporting follower and resilient means urging said follower into the path of movement of said slide;

a lever rotatably mounted to said frame and having first caming means formed thereon;

first detent means on said slide, cooperatively engaging said first caming means with said slide in said battery position and thereby restraining said slide against movement out of said battery position;

second caming means on said lever, positioned in the path of movement of said slide; and cam engaging means on said slide, cooperatively engaging said second caming means in response to movement of said slide into said battery position, for rotating said lever and thereby forcing said first caming means into cooperative engagement with said first detent means, whereby movement of said slide out of said battery position upon discharge of a cartridge is delayed until the gases in said barrel produced by such discharge exit the muzzle, thereby reducing the gas pressure within the barrel to a predetermined safe level.

17. The firearm of claim 16 comprising, further:

second detent means on said slide for cooperatively engaging said first caming means and thereby releasably locking said slide in a third position intermediate said battery position and said full-recoil position, wherein said cartridge receiver is in registry with said magazine; and third caming means on said lever, cooperatively engaging said magazine follower in response to the discharge of the last cartridge in said magazine, for rotating said lever and thereby forcing said first caming means into cooperative engagement with said second detent means.

18. The firearm of claim 17 comprising, further:

a plunger reciprocably mounted to said frame adjacent said lever;

fourth caming means on said plunger, adapted to engage said lever and thereby resist disengagement of said first caming means and said first detent means when said first caming means and said first detent means are in engagement;

lever-engaging means on said plunger, adapted to engage said lever and thereby restrain said lever against rotation when said first caming means is out of engagement with said first detent means; and resilient means acting between said frame and said plunger, urging said fourth caming means and said lever-engaging means into alternate cooperative engagement with said lever.

19. The firearm of claim 18 comprising, further:

manually operable safety means mounted to said frame effectively immobilizing said plunger with said forth caming means in engagement with said lever and thereby preventing disengagement of said first caming means and said first detent means.

20. The firearm of claim 19, wherein said safety means comprises a lever mounted to the frame for rotation into abutment with the end of said plunger remote from said fourth caming means.

* * * * *